US011118342B1

(12) United States Patent
Ahmed et al.

(10) Patent No.: US 11,118,342 B1
(45) Date of Patent: Sep. 14, 2021

(54) WALL PANEL SYSTEM AND METHOD OF USE

(71) Applicants: Mohammed Ahmed, Edmonton (CA); Asra Ahmed, Edmonton (CA)

(72) Inventors: Mohammed Ahmed, Edmonton (CA); Asra Ahmed, Edmonton (CA)

(73) Assignee: AJN INVESTMENT & DEVELOPMENT 2008 LTD, Edmonton (CA)

( * ) Notice: Subject to any disclaimer, the term of this patent is extended or adjusted under 35 U.S.C. 154(b) by 0 days.

(21) Appl. No.: 16/577,554

(22) Filed: Sep. 20, 2019

(51) Int. Cl.
*E04B 1/14* (2006.01)
*E04B 2/58* (2006.01)

(52) U.S. Cl.
CPC ..... *E04B 1/14* (2013.01); *E04B 2/58* (2013.01); *E04B 2103/02* (2013.01); *E04B 2103/04* (2013.01)

(58) Field of Classification Search
CPC ..... E04B 1/14; E04B 2/58; E04B 2103/02; E04B 2103/04
See application file for complete search history.

(56) References Cited

U.S. PATENT DOCUMENTS 2,198,885 A * 4/1940 Price ..... E04C 2/049 428/70
4,694,624 A * 9/1987 Juhas ..... E04C 1/397 52/223.7
4,774,794 A * 10/1988 Grieb ..... E04B 7/225 52/309.12
5,596,853 A * 1/1997 Blaney ..... E04C 2/044 52/223.7
5,862,640 A * 1/1999 Negri ..... E04B 2/16 52/438
6,164,035 A * 12/2000 Roberts ..... E04B 1/14 52/220.2
6,235,367 B1 * 5/2001 Holmes ..... E04B 1/14 428/223
6,412,243 B1 * 7/2002 Sutelan ..... B29C 44/12 428/182
6,510,667 B1 * 1/2003 Cottier ..... E04C 3/07 52/742.14
6,851,235 B2 * 2/2005 Baldwin ..... E04B 2/42 52/309.12
7,984,594 B1 * 7/2011 Propst ..... B32B 3/18 52/309.12
8,966,845 B1 * 3/2015 Ciuperca ..... E04F 13/047 52/405.3
10,584,475 B1 * 3/2020 Idd ..... E04B 1/165
2002/0090871 A1 * 7/2002 Ritchie ..... E04C 2/043 442/42

(Continued)

*Primary Examiner* — James M Ference
(74) *Attorney, Agent, or Firm* — Leavitt Eldredge Law Firm

(57) ABSTRACT

A wall panel system includes one or more building blocks, each of the one or more building blocks having a front face made of a first calcium silicate board; a back face made of a second calcium silicate board; and a core positioned between the front face and the back face, the core composed of cement/sand and expandable polystyrene foam; the one or more building blocks are used for building construction. In addition to this will produce panels without calcium silicate board just panels with cement/sand and expandable polystyrene.

5 Claims, 5 Drawing Sheets

(56) References Cited

U.S. PATENT DOCUMENTS

2002/0139082 A1* 10/2002 DeFord ..... C04B 28/02 52/783.1
2005/0086900 A1* 4/2005 Reynolds ..... E04B 1/7612 52/745.19
2006/0070321 A1* 4/2006 Au ..... C04B 28/26 52/232
2006/0201090 A1* 9/2006 Guevara ..... E04B 5/04 52/309.12
2006/0292358 A1* 12/2006 Robertson ..... B28B 3/12 428/312.4
2007/0261364 A1* 11/2007 Ritchie ..... E04C 2/36 52/783.1
2009/0193740 A1* 8/2009 Bennett ..... E04C 1/40 52/309.1
2009/0249726 A1* 10/2009 Garcia Fernandez .... F24D 5/10 52/506.01
2010/0088984 A1* 4/2010 Guevara ..... E04B 5/19 52/220.1
2010/0310846 A1* 12/2010 Berke ..... C04B 28/04 428/219
2011/0173911 A1* 7/2011 Propst ..... B32B 5/26 52/309.13
2011/0239851 A1* 10/2011 Mason ..... B32B 27/04 89/36.02
2011/0268916 A1* 11/2011 Pardue, Jr. ..... B32B 5/245 428/116
2012/0180419 A1* 7/2012 Propst ..... B32B 13/02 52/479
2013/0305642 A1* 11/2013 Propst ..... C04B 28/04 52/309.3
2013/0309454 A1* 11/2013 Propst ..... E04C 1/40 428/161
2014/0141160 A1* 5/2014 Strachan ..... E04C 2/06 427/209
2014/0150362 A1* 6/2014 Propst ..... E04C 2/296 52/309.12
2014/0260034 A1* 9/2014 Ciuperca ..... E04C 5/12 52/405.3
2015/0076726 A1* 3/2015 Mathieu ..... C08J 9/224 264/51
2015/0076728 A1* 3/2015 Mathieu ..... B28B 23/0006 264/72
2015/0076730 A1* 3/2015 Mathieu ..... B28B 23/0087 264/171.17
2015/0079356 A1* 3/2015 Mathieu ..... E04C 2/28 428/192
2016/0010329 A1* 1/2016 Marstein ..... E04C 2/46 52/293.3
2016/0083954 A1* 3/2016 Wang ..... E04C 2/46 52/204.1
2016/0222651 A1* 8/2016 MacKinlay ..... E04G 25/061
2017/0121961 A1* 5/2017 Hodson ..... E04C 2/2885
2017/0145687 A1* 5/2017 Mori ..... E04B 2/46
2017/0191259 A1* 7/2017 Negev ..... E04F 13/077
2017/0247881 A1* 8/2017 Morton ..... E04B 2/02
2018/0086023 A1* 3/2018 Ikeda ..... C04B 14/04
2018/0155246 A1* 6/2018 Prante ..... B32B 7/12
2018/0195281 A1* 7/2018 Tanami ..... E04C 1/40
2018/0282218 A1* 10/2018 Mabey ..... C04B 18/027
2019/0390452 A1* 12/2019 Baker ..... E04B 2/18

* cited by examiner

WALL PANEL SYSTEM AND METHOD OF USE

BACKGROUND

1. Field of the Invention

The present invention relates generally to building systems, and more specifically, to a wall panel system that utilizes novel building blocks that improve efficiency, ease of use, and structural integrity.

2. Description of Related Art

Building systems are well known in the art and are effective means to construct walls, floors, roofs, and the like. For example, FIG. 1 depicts a conventional building system 101, wherein a plurality of bricks 103, 105 are secured together via an adhesive 107 to create a wall structure. During use, the wall structure is slowly erected with the bricks and the adhesive, typically through a labor intensive process. Other systems may utilize wooden construction or other materials to construct the building structure, all of which have drawbacks, some of which will be discussed herein.

Conventional building systems have several disadvantages and room for improvement. For example, the construction of buildings is typically time consuming and expensive, and further may require special expertise and training. In addition, conventional systems have limited structural integrity and may not be able to withstand weather, fire, or other elements.

Accordingly, it would be desirable and is an object of the present invention to provide a system that is both time and money efficient, while still providing for a quality building structure that is able to withstand elements and is also environmentally friendly. Yet further, it would be desirable, and is an object of the present invention, to provide energy saving features to a building thereby providing for a quality product for use in building. The system of the present invention combines strength and performance of cold formed steel framing with superior insulation properties of expandable polystyrene that results in a superior building technology that replaces traditional framing, insulation, and sheathing components with a single, easily installed system.

Accordingly, although great strides have been made in the area of building systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
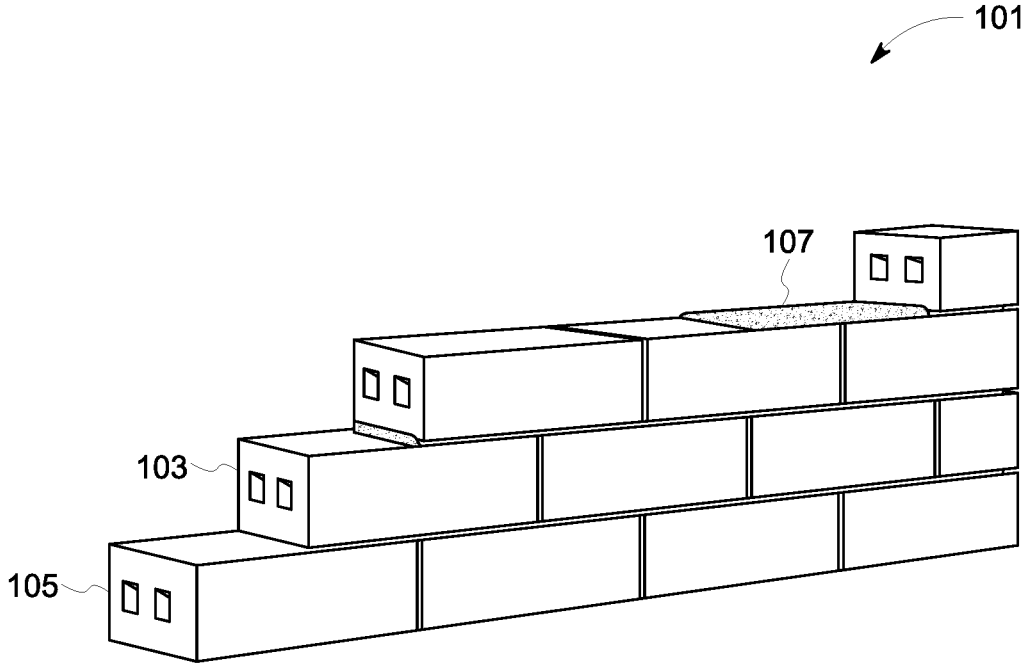
FIG. 1 is an oblique view of a common building system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional building systems. Specifically, the present invention provides for a building system that utilizes unique and novel building blocks that are efficient, economical, structurally sound, and therefore provide for an improved structure. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
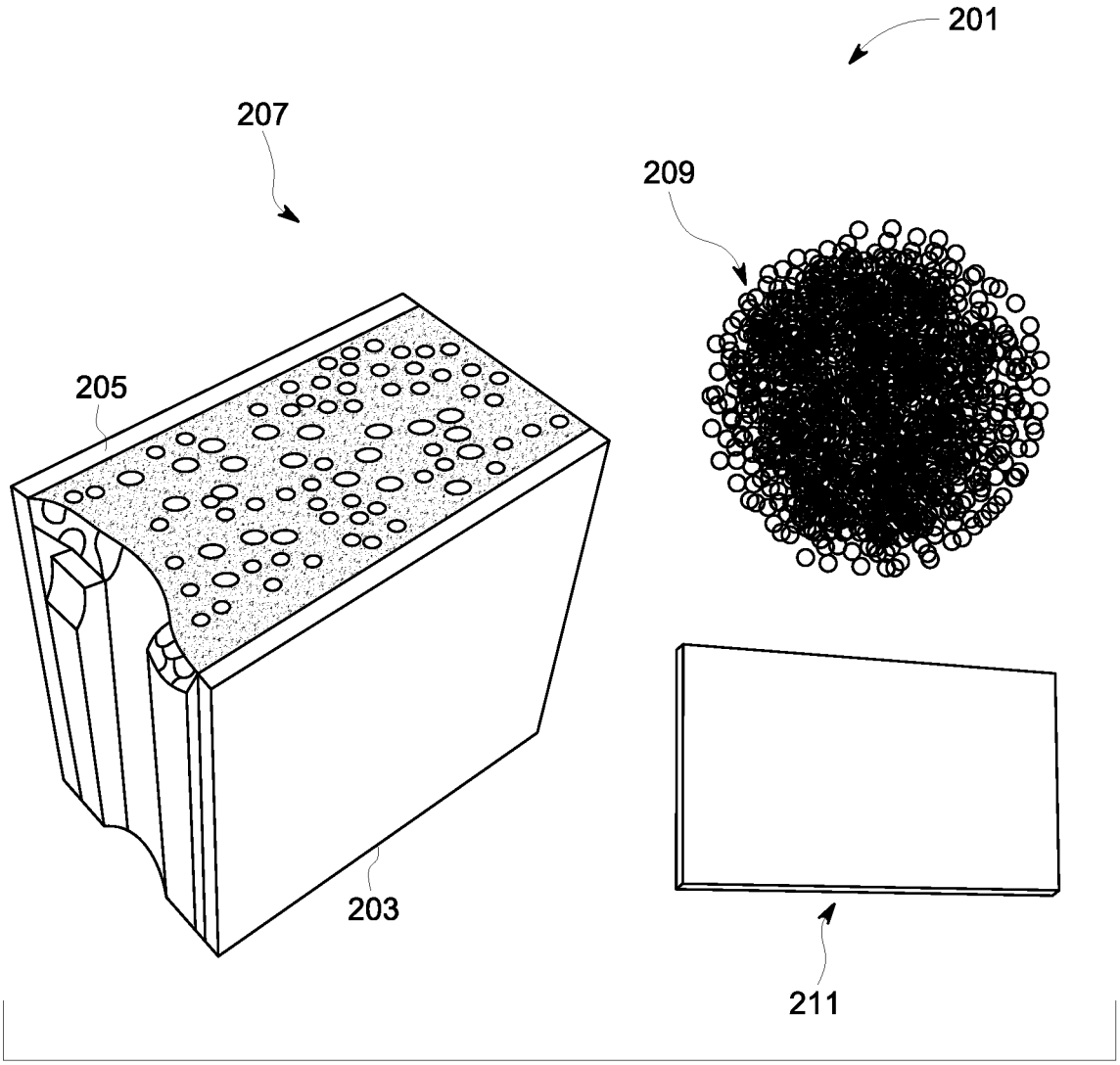
FIG. 2 is a schematic of a building block in accordance with a preferred embodiment of the present application.

Referring now to the drawings wherein like reference characters identify corresponding or similar elements throughout the several views, FIG. 2 depicts a schematic of a building block system 201 in accordance with a preferred embodiment of the present application. It will be appreciated that system 201 overcomes one or more of the above-listed problems commonly associated with conventional building systems.

In the contemplated embodiment, system 201 includes a front face 203 and a back face 205, both composed of a calcium silicate board 211. The front face and back face form a core 207 positioned between the front face and the back face, the core being filled with and composed of cement, sand, and expandable polystyrene foam 209. It should be appreciated that the building block system 201 can vary in size and shape. In one particular embodiment, each of the front face and back face are 4.5 mm in thickness, however, it is contemplated that a range of thickness can be utilized.

It should be appreciated, and will be discussed in more detail herein, that the building block system 201 provides for many improvements and benefits over convention building systems. A structure composed of the building block system(s) 201 will have improved energy savings, namely, the structure will have anti-freezing and heat preserving qualities that will save the user money as well as provides environmental benefits. In addition, the structure will be fireproof due to the use of the calcium silicon board, such structure being able to withstand a high temperature of 1000 degrees Celsius for approximately four hours. Yet further, the structure will be waterproof and have improved sound insulation, particularly due to the expandable polystyrene foam and cement core.

Figure 3:
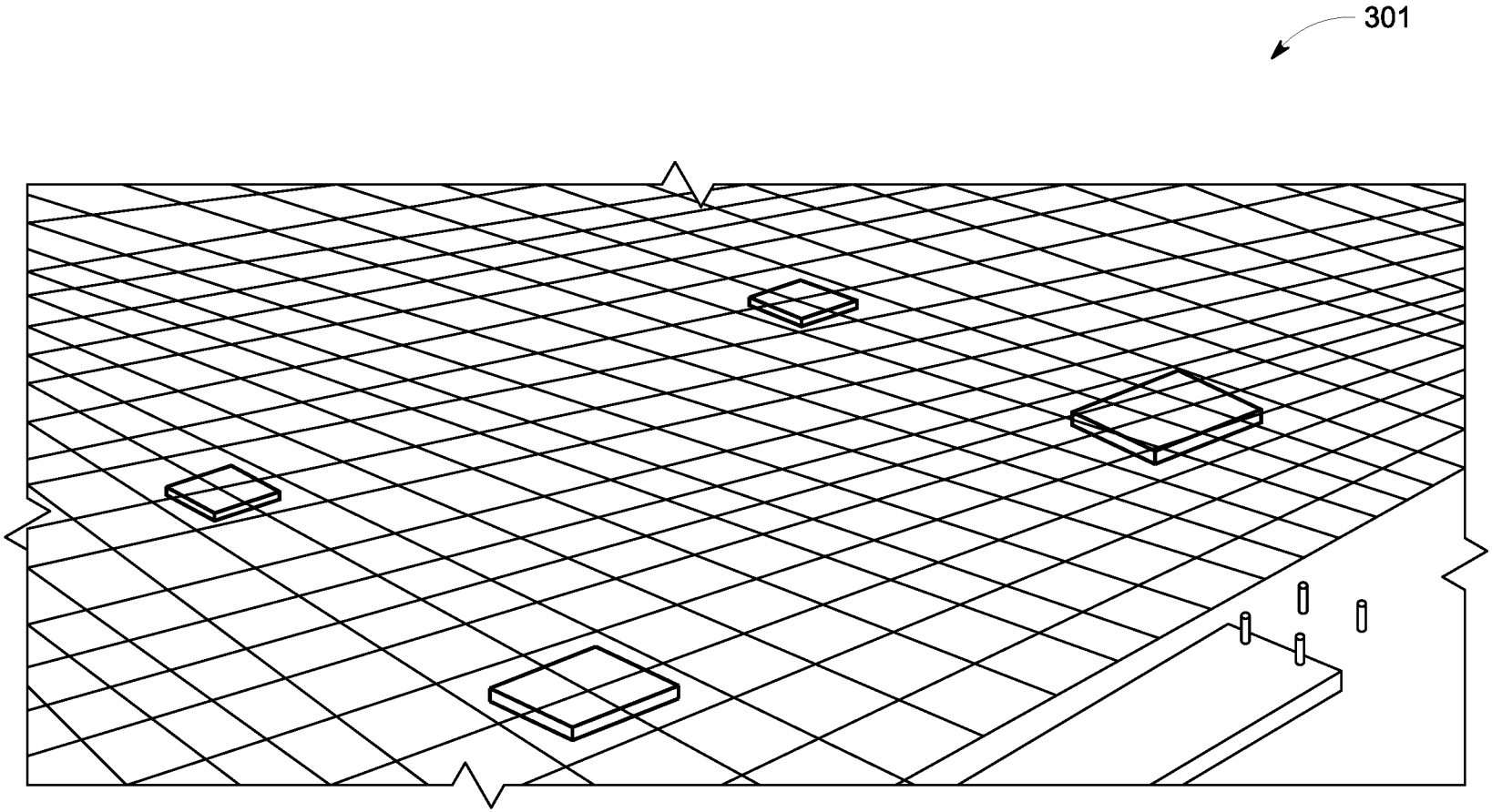
FIG. 3 is an oblique view of a steel frame for use with the building block of FIG. 2.
Figure 4:
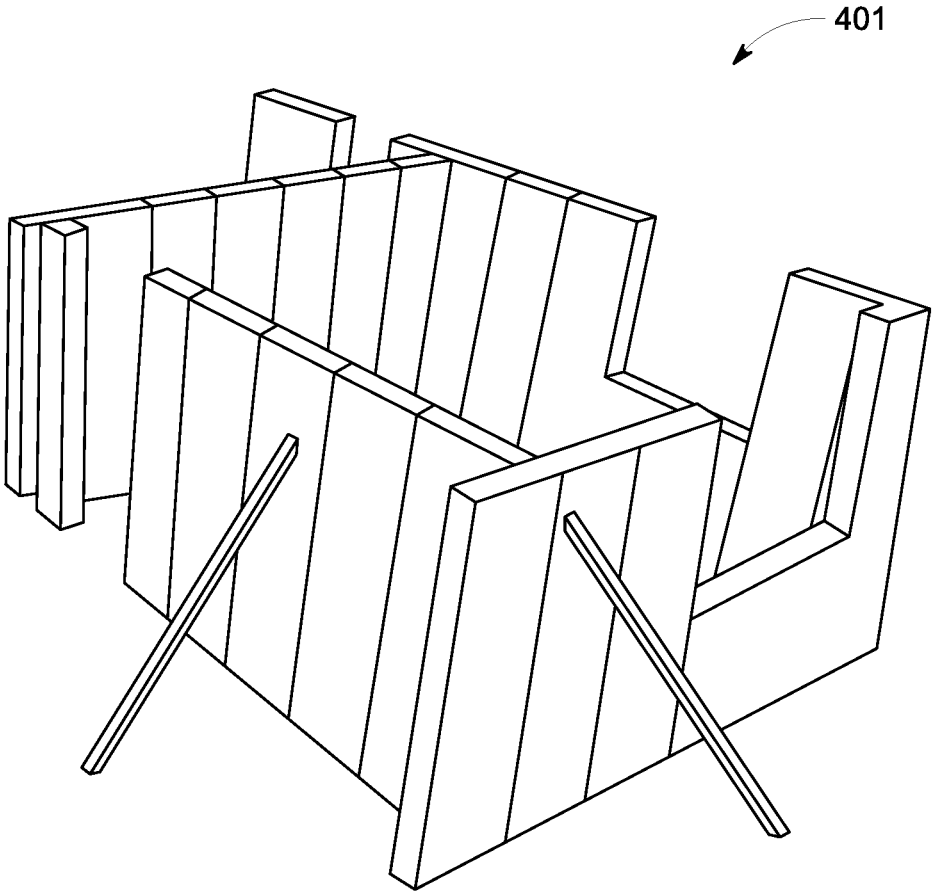
FIG. 4 is an oblique view of a structure as created via the building block of FIG. 2.

In FIG. 3, a simplified oblique view depicts a steel frame 301 that can be utilized to support a plurality of building block systems 201. The steel frame 301 can be erected into various sizes and for use in various structures, such as walls, floors, roofs, or the like. In FIG. 4, a structure 401 that is created via a steel frame and a plurality of building block systems 201 is shown partially completed.

It should be appreciated that a structure created via the steel frame and building block systems can be a wall, roof, floor, or the like. In addition, it should be appreciated that the system is suitable for extensive building projects. The use of the building block system is easy and efficient, allowing for users to quickly and efficiency build a structure when compared to conventional methods.

A wall created by the system of the present invention can be aesthetically improved via being covered with ceramic tiles, wallpaper, wood panel, coatings, etc. In addition, the system allows for thin construction, with a thickness ranging from 60 mm to 180 mm, thereby saving a lot of construction space when compared to a traditional block. Further, the weight of a panel created with the building blocks is 1/12 that of a traditional block, thereby saving 2/3 of the cost on construction structure.

The system has further benefits, including being non-toxic, recyclable, composed of recycled materials, results in minimal waste, can be pre-cut to a specific requirement for a project, sustainable, does not rust or decompose, requires minimal maintenance, insect/rodent resistant, and other benefits.

Figure 5:
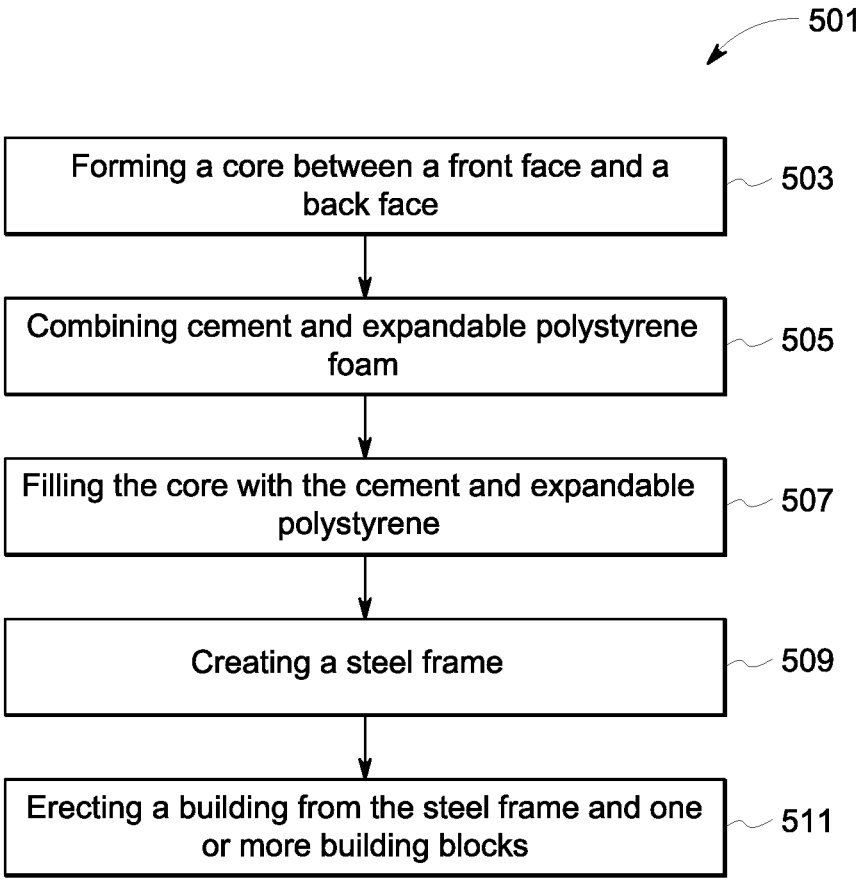
FIG. 5 is a flowchart of the method of use of the building block of FIG. 2.

In FIG. 5, a flowchart 501 depicts the method of use of system 201. During use, a core is formed between a front face and a back face, the front and back face being composed of calcium silicate board, as shown with box 503. Cement and expandable polystyrene foam are combined to fill the core of the building block, as shown with boxes 505, 507. As needed by the user, a steel frame is constructed for a desirable structure, such as a wall, as shown with box 509. A structure is then erected using the steel frame and the plurality of building blocks, as shown with box 511.

It should be appreciated that one of the unique features believed characteristic of the present application is the use of the expandable polystyrene and cement between calcium silicate board. These structural components provide for the many benefits discussed above, as well as other benefits.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A wall panel system, comprising:

one or more building blocks, each of the one or more building blocks having:

a front face made of a first calcium silicate board;

a back face made of a second calcium silicate board; and a block core positioned between the front face and the back face, the block core composed solely of cement, sand, and expandable polystyrene foam, wherein the one or more building blocks are used for building construction.

2. The system of claim 1, wherein the first calcium silicate board is between 4.5 mm to 10 mm thick.

3. The system of claim 1, wherein the building block is between 60 mm and 180 mm thick.

4. The system of claim 1, further comprising:

a steel frame configured to support the one or more building blocks.

5. A method of building, the method comprising:

providing the wall panel system of claim 1;

creating a steel frame configured to support the one or more building blocks; and erecting a building from the steel frame and the one or more building blocks.

* * * * *